US009307854B2

(12) United States Patent
Myers

(10) Patent No.: US 9,307,854 B2
(45) Date of Patent: Apr. 12, 2016

(54) RECONFIGURABLE ARTICLE HOLDER

(71) Applicant: Maggie Myers, Belgrade, MT (US)

(72) Inventor: Maggie Myers, Belgrade, MT (US)

( * ) Notice: Subject to any disclaimer, the term of this patent is extended or adjusted under 35 U.S.C. 154(b) by 39 days.

(21) Appl. No.: 14/341,683

(22) Filed: Jul. 25, 2014

(65) Prior Publication Data

US 2015/0265083 A1 Sep. 24, 2015

Related U.S. Application Data

(60) Provisional application No. 61/955,213, filed on Mar. 19, 2014.

(51) Int. Cl.

| | |
|---|---|
| ***A45F 3/16*** | (2006.01) |
| ***A47G 23/02*** | (2006.01) |
| ***B65D 25/22*** | (2006.01) |
| ***B65D 25/54*** | (2006.01) |
| ***B65D 81/38*** | (2006.01) |
| ***A45F 5/10*** | (2006.01) |

(52) U.S. Cl.

CPC ..... *A47G 23/0216* (2013.01); *A45F 5/10* (2013.01); *B65D 25/22* (2013.01); *B65D 25/54* (2013.01); *B65D 81/3876* (2013.01); *A47G 2023/0291* (2013.01)

(58) Field of Classification Search

CPC ..... A45F 3/16; A45F 3/18; A45F 3/20; A47G 23/0216; B65D 81/3876; B65D 81/3888

USPC ..... 220/751; 224/148.5, 148.4, 148.6, 224/148.7, 148.1

See application file for complete search history.

(56) References Cited

U.S. PATENT DOCUMENTS

| | | | | | |
|---|---|---|---|---|---|
| 2,494,632 | A * | 1/1950 | Rodin | A61J 9/06 | 224/148.5 |
| 4,180,111 | A * | 12/1979 | Davis | A45C 7/0063 | 383/10 |
| 4,282,279 | A * | 8/1981 | Strickland | B65D 25/34 | 150/901 |
| 4,401,245 | A * | 8/1983 | Zills | B65D 81/3886 | 215/12.1 |
| 4,526,280 | A * | 7/1985 | Taylor | B65D 77/0406 | 150/154 |
| 4,718,623 | A * | 1/1988 | McClure | A61J 9/06 | 248/102 |
| 4,754,903 | A * | 7/1988 | Dennis | A45F 3/16 | 224/148.3 |
| 4,802,602 | A * | 2/1989 | Evans | B65D 81/3886 | 220/739 |
| 5,320,249 | A * | 6/1994 | Strech | B65D 81/3876 | 220/739 |
| 5,390,838 | A * | 2/1995 | Jafarkhani | A45F 5/00 | 224/148.4 |
| 5,570,824 | A * | 11/1996 | Lyon et al. | A45F 3/00 | 224/148.5 |
| 5,797,528 | A * | 8/1998 | McDuffie | A01K 97/06 | 150/154 |
| 5,873,551 | A * | 2/1999 | Jones | A61J 9/06 | 224/600 |
| 5,915,580 | A * | 6/1999 | Melk | B65D 23/08 | 215/386 |
| 6,073,796 | A * | 6/2000 | Mogil | A45F 3/16 | 215/12.1 |
| 6,182,872 | B1 * | 2/2001 | Six | A45F 3/00 | 224/148.3 |

(Continued)

*Primary Examiner* — King M Chu

(74) *Attorney, Agent, or Firm* — Weide & Miller, Ltd.

(57) ABSTRACT

A reconfigurable article holder comprises a sleeve defining a cavity and having an inner surface and an outer surface. The cavity receives and supports a container in a first container supporting configuration, wherein the inner surface of the sleeve contacts the container. The sleeve includes first and second fastener portions which are mateable to form a container-surrounding opening operable to receive and support a beverage container in a second container supporting position, wherein the outer surface of the sleeve contacts the beverage container. A strap having sufficient strength to support the weight of a beverage container attaches to the sleeve at least one opening. The first fastening portion may be disposed on the inner surface of the sleeve, while the second fastening portion may be disposed on the outer surface of the sleeve. The first and second fastening portions may be further mateable to form a storage configuration.

18 Claims, 6 Drawing Sheets

(56) References Cited

U.S. PATENT DOCUMENTS

| | | | | |
|---|---|---|---|---|
| 6,401,993 | B1 * | 6/2002 | Andrino | A45F 5/00 224/148.5 |
| 6,862,827 | B2 * | 3/2005 | Gregory | G09F 3/207 150/145 |
| 7,896,205 | B1 * | 3/2011 | Gonzalez et al. | A45F 5/00 224/148.1 |
| 7,938,302 | B2 * | 5/2011 | Gibson | A45F 3/04 224/660 |
| 8,251,269 | B2 * | 8/2012 | Winneur | A45C 9/00 224/629 |
| 8,757,427 | B2 * | 6/2014 | Hiner | B65D 23/104 215/12.1 |
| 2011/0139803 | A1 * | 6/2011 | Leslie | A47G 23/0216 220/739 |
| 2014/0239003 | A1 * | 8/2014 | Branca, Jr. | A47G 23/0216 220/737 |
| 2014/0339244 | A1 * | 11/2014 | Arnold | B65D 81/3886 220/739 |

* cited by examiner

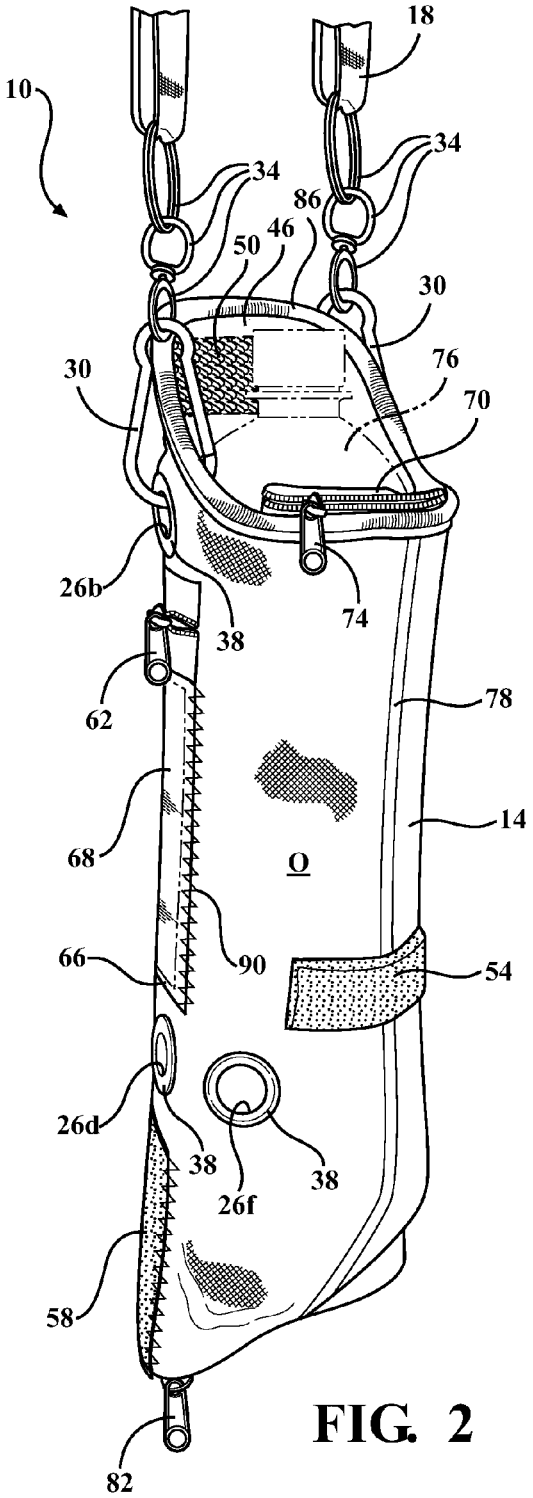
FIG. 2
FIG. 3
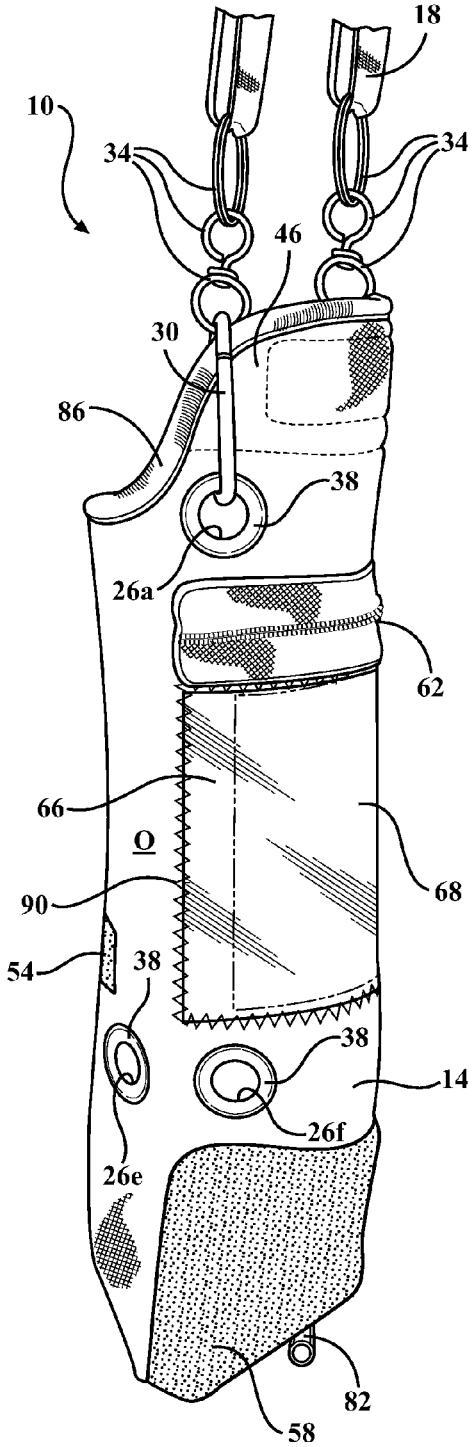

RECONFIGURABLE ARTICLE HOLDER

PRIORITY CLAIM

The present application claims priority to and the benefit of U.S. Provisional Patent Application No. 61/955,213 filed on Mar. 19, 2014, the specification of which is incorporated herein in its entirety.

FIELD OF THE INVENTION

The present invention relates generally to article holders and carriers including wallets and beverage sleeves.

BACKGROUND OF THE INVENTION

The importance of hydration, especially during physically demanding activities such as hiking or extended periods of walking, is widely recognized. Beverage holders which allow for hands-free carrying of a beverage container can promote hydration by providing ready access to the container. Insulating beverage holders provide the additional advantage of reducing the rate of heat transfer from the beverage container, thereby keeping the drink colder or hotter for a longer period of time.

Typical beverage holders have a relatively fixed shape and size, allowing a person to carry a beverage container of approximately the same shape and/or size. While such holders may be adequate for repeated use of the same type of container, a beverage holder that can support containers of different shapes and sizes would be much more convenient and useful. By way of example, conventioneers and travelers often find themselves in unfamiliar locales where beverages are provided in containers having a variety of different shapes. A reconfigurable, hands-free beverage holder would allow such a user to conveniently carry a beverage no matter the container in which it is provided.

Securing other articles during such situations can also be a challenge. A typical wallet carried in a purse which may be regularly set down and picked back up or in a back pants pocket may be easily stolen, especially when there is a concentration of people in a given location. Clothing lacking pockets may exacerbate the ability of a person to carry necessary items, such as identification, payment cards, cash, keys, etc., during travel or while at a convention, or while participating in a fitness activity such as hiking. An article holder having compartments within which to store such items which can be easily converted to a beverage holder would be particularly useful in such situations.

SUMMARY

To overcome the drawbacks of the prior art and provide additional benefits, a reconfigurable article holder is disclosed. The article holder comprises a sleeve having an inner surface and an outer surface. The sleeve may be formed from thermally insulating material. The sleeve defines a cavity, with the cavity operable to receive and support a beverage container in a first container supporting configuration. In the first container supporting configuration, the inner surface of the sleeve contacts the beverage container. The sleeve includes first and second fastener portions which are mateable to form a container-surrounding opening operable to receive and support a beverage container in a second container supporting position. In the second container supporting position, the outer surface of the sleeve contacts the beverage container.

The reconfigurable article holder further comprises a strap attached to the sleeve and having sufficient strength to support the weight of a beverage container. The strap may be detachable. The strap may also be adjustable. The strap may extend through the sleeve at least one reinforced opening.

The first fastening portion may be disposed on the inner surface of the sleeve, while the second fastening portion may be disposed on the outer surface of the sleeve. The first and second fastening portions may be further mateable to form a storage configuration. In the storage configuration, the first and second fastening portions attach so as to decrease the circumference of the container-surrounding opening such that the container-surrounding opening can no longer support an average-sized beverage container.

The article holder may further include a third fastening portion, with the first fastening portion being mateable with the third fastening portion to form an additional storage configuration. Attachment of the first and third fastening portions may close the cavity to provide secure storage and transport of items within the article holder.

The article holder may also include a securable pocket attached to the sleeve. The securable pocket may secure with a zipper. In one embodiment, the securable pocket sits within the cavity. In another embodiment, the securable pocket attaches to the outer surface of the sleeve. In this embodiment, the pocket may be transparent, such that items within the pocket are viewable without removing the items from the pocket.

The article holder may include one or more gripping protrusions disposed on the outer surface of the sleeve and operable to retain a beverage container within the container-surrounding opening when the article holder is in the second container supporting configuration.

In another embodiment of the invention, a reconfigurable article holder is disclosed comprising a sleeve and an adjustable strap. The sleeve includes a first opening, a second opening spaced from and generally horizontally aligned with the first opening, and a third opening spaced from and generally vertically aligned with the first opening. The sleeve defines a cavity operable to receive and support a beverage container in a first container supporting configuration. First and second fastener portions disposed on the sleeve are mateable to form a container-surrounding opening operable to receive and support a beverage container in a second container supporting configuration, with the second container supporting configuration being rotated approximately ninety degrees from the first container supporting configuration. The strap detachably connects to the sleeve at the first and second openings when the article holder is in the first container supporting configuration, and at the first and third openings when the article is in the second container supporting position.

The sleeve may define an inner surface and an outer surface, with the inner surface of the sleeve contacting a beverage container when the article holder is in the first container supporting configuration and the outer surface of the sleeve contacting a beverage container when the article holder is in the second container supporting configuration. The first fastening portion may be disposed on the inner surface of the sleeve, with the second fastening portion disposed on the outer surface of the sleeve.

The first and second fastening portions may be further attachable to form a storage configuration. The sleeve may also include a third fastening portion mateable with the first fastening portion to form an additional storage configuration. The strap may attach to the sleeve at the first and second openings when the article holder is in either of the storage configurations. The sleeve may include a securable pocket. The sleeve may be formed from a thermally insulating material.

BRIEF DESCRIPTION OF THE DRAWINGS

Various other objects, features and advantages of the present invention will become fully appreciated when considered in conjunction with the accompanying drawings, wherein like reference characters denote the same or similar parts throughout the several views.

FIG. 2 illustrates a rear view of the article holder of FIG. 1, with the article holder assembled into a first container supporting configuration.

FIG. 3 illustrates a front view of the article holder in the first container supporting configuration.

DETAILED DESCRIPTION OF EMBODIMENTS

Figure 1:
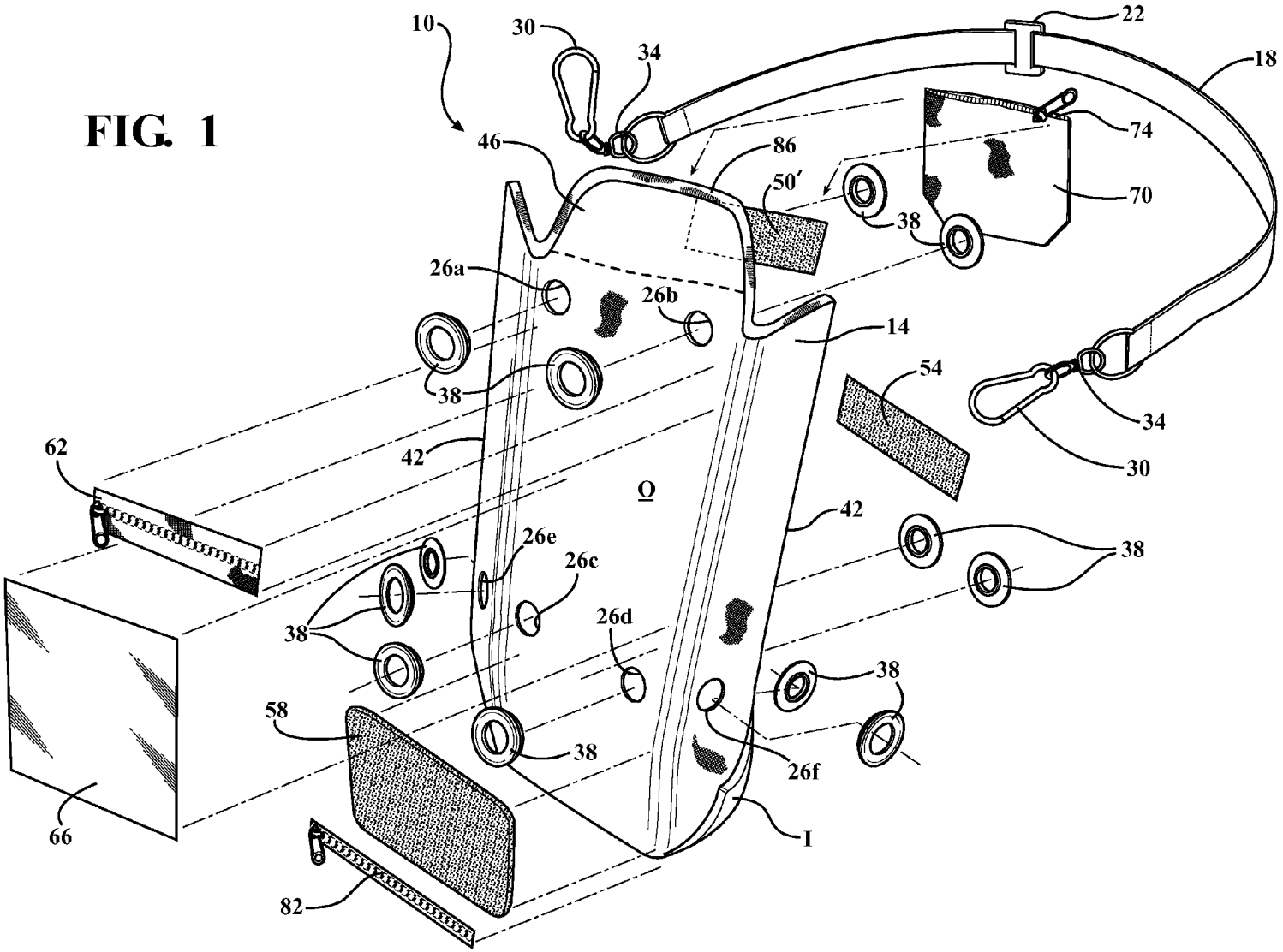
FIG. 1 illustrates an exploded view of an article holder according to the present invention.

Referring to the drawings, wherein like reference numbers refer to like components, FIG. 1 shows an exploded view of a disassembled reconfigurable article holder according to the present invention generally at 10. The article holder 10 includes a sleeve 14 formed from a flexible insulating material such as neoprene or low-resilience polyurethane, or from any other suitable material. The sleeve 14 may comprise a single piece of material, as shown in FIG. 1, or may include two or more different portions. A carrying strap 18 attaches to the sleeve 14 and may be adjustable, such as by an associated adjuster 22. The strap 18 may be detachable, and may attach to the sleeve 14 through one or more openings 26*a-f*. In the embodiment shown, carabiners 30 extend through connectors 34 attached to the strap 18 and may further extend through the sleeve 14 at one or more of the openings 26*a-f*, thereby detachably connecting the sleeve 14 and the strap 18. However, detachable connection of the sleeve 14 and the strap 18 may occur in any other manner within the scope of the invention. Grommets 38 may be employed to enhance the structural integrity of the sleeve 14 at the openings 26*a-f*. The strap 18 allows for hands-free carrying of the article holder 10, as it may worn over a user's neck, shoulder, or other body part, or draped around another object.

The sleeve 14 defines an inner surface I, an outer surface O, and side edges 42. The sleeve 14 may additionally define a flap 46. A first fastener portion 50 is configured to operatively engage with one or more of second and third fastener portions 54, 58 as will be described in detail below. The fastener portions 50, 54, 58 may be a hook-and-loop type closure, with the first fastener portion 50 being one of hooks and loops and the second and third fastener portions 54, 58 being the other of hooks and loops. The fastener portions 50, 54, 58 may also be any other type of mateable fasteners, such as snaps, magnetic closures, zippers, or the like. Additional fastening options may further be employed within the scope of the invention. A zipper 62 and a panel 66 may attach to the outer surface O of the sleeve 14 to form a pocket. The panel 66 may be transparent, thereby allowing a user to securely display a convention badge, passport, or other identification from the pocket, shown as 68 in FIGS. 3, 5, 7 and 9. An additional storage compartment 70 also having a zipper 74 may also be part of the article holder 10.

FIG. 2 presents a rear view of the article holder 10 in a first container supporting position, with the article holder 10 supporting a water bottle 76. As used herein, "rear view" and "front view" merely represent opposite sides of the article holder 10. Generally speaking, the front view will be the portion visible to others when the article holder in use 10, while the rear view will be the portion resting against a user's body and therefore not visible to others when the article holder 10 is in use. However, given the convertible nature of the article holder 10 and the number of different ways it may be worn by a user, "front view" and "rear view" may refer to different opposing sides of the article holder 10 within the scope of the invention. Additionally, the article holder 10 need not support a container in the first container supporting position to practice the present invention. Instead, the cavity may be filled with other items, or may remain empty.

To reach the first container supporting position, the side edges 42 of the sleeve 14 are brought together such that the inner surface I of the sleeve 14 becomes mostly hidden, while the outer surface O of the sleeve 14 is generally visible. The side edges 42 attach to one another, such as by stitching 78, hook-and-loop, zipper or any other fastening device to define a cavity. The cavity may be sized to receive an average beverage container, such as water bottle 76, or any other item. It should be noted that when the article holder 10 is in the first container supporting position and supporting a container such as water bottle 76, the inner surface I of the sleeve 14 contacts the outer surface of the water bottle 76 within the cavity. The cavity may be sized such that the water bottle 76 sits within the cavity in a semi-friction-fit, or may be larger than the water bottle 76, thereby allowing for additional secure storage of certain items within the cavity even when a container is being supported.

A zipper 82 may be provided at the bottom of the cavity to prevent articles and/or a beverage container from falling out of the sleeve 14 when in use, especially when a friction fit is not achievable. The zipper 82 may also provide reinforcement at the bottom of the sleeve 14. The storage compartment 70 may attach at the top of the sleeve 14, with the storage compartment 70 configured for storage either inside or outside of the cavity. The zipper 74 allows for secure storage of items within the compartment 70. Attachment of the storage compartment 70 and the associated zipper 74 may also provide reinforcement at the top of the sleeve 14. Additional reinforcing material 86 may be used along other edges of the sleeve 14 as necessary.

The first fastener portion 50 may be sewn to the inner surface I of the sleeve 14 at the flap 46 (FIG. 2), while the second and third fastener portions 54, 58 may attach to the outer surface O of the sleeve 14 (FIGS. 2 and 3). In the embodiment shown, the second fastener portion 54 is a narrow fabric strip disposed across the stitching 78 just above the openings 26*e-f*. As shown in FIG. 3, which illustrates a front view of the article holder 10 in the first container supporting position, the third fastener portion 58 may be a wider swath of fabric disposed toward the bottom of the sleeve 14 on the opposite side of the article holder 10, below the openings

26*c-d*. The zipper 62 and the panel 66 may attach to outer surface O of the sleeve 14 just above the openings 26*c-d*, such as by stitching 90.

In the first container supporting position, the cavity may hold a beverage container as shown, or may hold other items. While the zipper 82 may close the cavity at the bottom, the top of the cavity may remain open, or the first fastener portion 50 may be configured to releasably attach to another portion of the sleeve 14 to also close off the top of the cavity. For instance, an additional second fastener portion (not shown) may be included just below the lip of the cavity, with the additional second fastener portion being mateable with the first fastener portion 50 to close the top of the cavity.

As shown in FIG. 2 and FIG. 3, the strap 18 may extend through the sleeve 14 at openings 26*a* and 26*b* when the article holder 10 is in the first container supporting position. This would allow a user to place the strap 18 around their neck or elsewhere across their body while still retaining the water bottle 76 in an upright position. However the strap 18 may extend through the sleeve 14 at other openings 26*c-f*, or may not be used at all if hands-free item toting is unnecessary.

Figure 4:
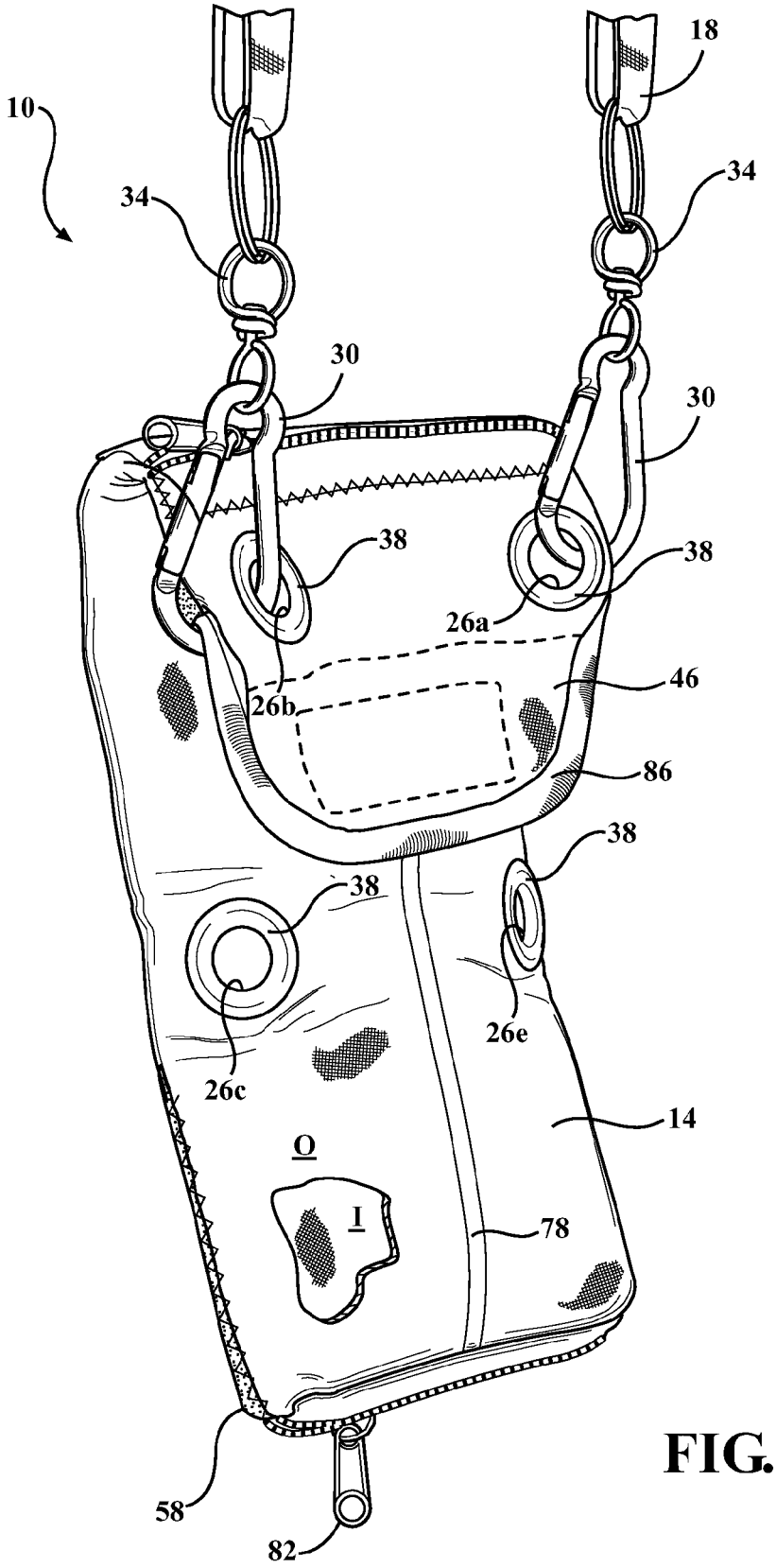
FIG. 4 illustrates a rear view of the article holder of FIG. 1 in a first storage configuration.
Figure 5:
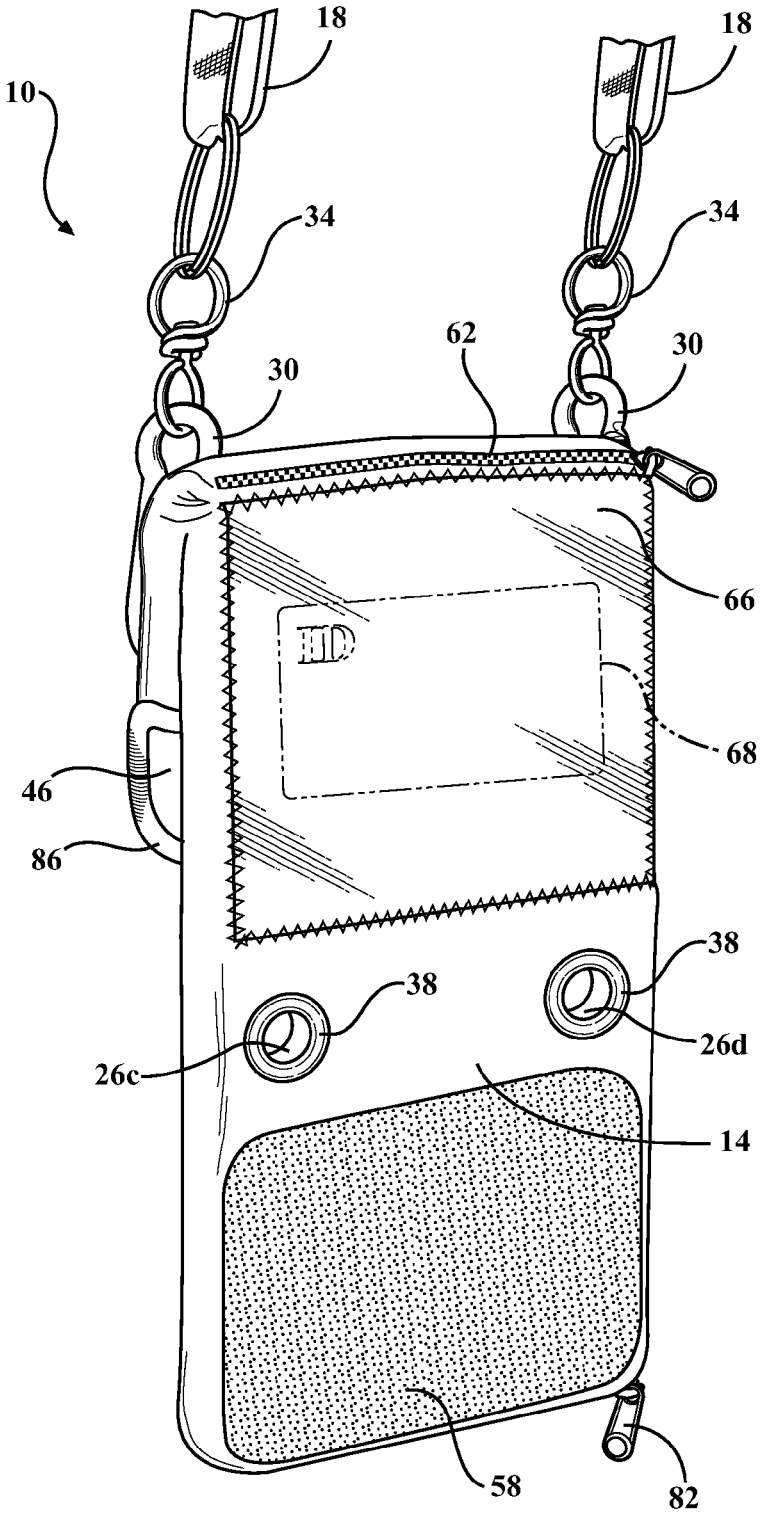
FIG. 5 illustrates a front view of the article holder in the first storage configuration.

FIG. 4 illustrates a rear view of the article holder 10 in a first storage configuration. To achieve the first storage configuration from the first container supporting configuration, the top of the sleeve 14, including the flap 46, is folded downward until the first fastener portion 50 engages the second fastener portion 54, thereby releasably attaching the sleeve 14 to itself to close the top of the cavity, while also restricting the size of the cavity. The storage compartment 70 may be tucked into the cavity prior to folding down the flap 46 and mating the fasteners 50, 54. Generally speaking, when the article holder 10 is in the first storage configuration, the cavity will not be large enough to accommodate an average-sized beverage container. Instead, other items may be stored within the cavity for secure transport. However, it is possible that a smaller beverage container may be one of the items secured in the cavity when the article holder 10 is in the first storage configuration, with the smaller beverage container constituting one of the items being stored. As shown in FIGS. 4 and 5, the strap 18 may connect to the sleeve 14 at openings 26*a-b* to allow the article holder 10 to be worn by a user.

Turning to FIG. 5, which presents a front view of the article holder 10 in the first storage configuration, when the panel 66 is transparent, identification 68 can be readily visible without removing the identification 68 from the pocket formed by the panel 66 and the zipper 62. Thus, if a user is wearing the article holder 10 with the front view facing outward, the identification 68 can be presented while still secure within the article holder 10. This can be especially useful in situations of travel, or when a convention badge must be repeatedly presented.

Figure 6:
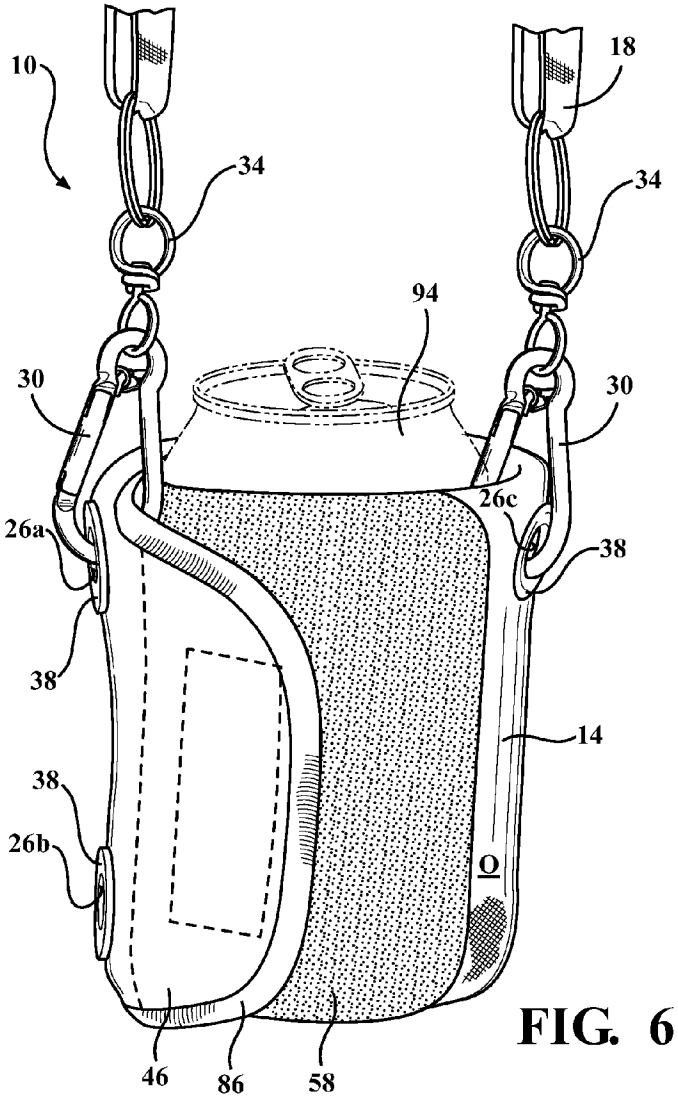
FIG. 6 illustrates a rear view of the article holder of FIG. 1 in a second container supporting configuration.

FIG. 6 shows a rear view of the article holder 10 in a second container supporting configuration, wherein the article holder 10 is supporting a can 94. To reach this configuration from the first container supporting position shown in FIG. 2 and FIG. 3, the bottom of the sleeve 14 is brought upward, thereby presenting the third fastener portion 58 for engagement. The top of the sleeve 14, including the flap 46, is then folded downward until the first fastener portion 50 engages the third fastener portion 58, thereby releasably attaching the sleeve 14 to itself to form a container-surrounding opening. It should be noted that the third fastener portion 58 may be considerably larger than the first fastener portion 50, thereby allowing adjustment of the size of the container-surrounding opening to accommodate containers of varying sizes and shapes. For a wider container, the first fastener portion 50 and the third fastener portion 58 may barely overlap. In contrast, for a narrower container, the first fastener portion 50 and the third fastener portion 58 may overlap a great deal, thus narrowing the container-surrounding opening.

It can be seen that the sleeve 14 must be rotated 90 degrees to properly support a container in the second container supporting configuration to maintain the can 94 or other container in an upright position. Thus, one end of the strap 18 may attach to the sleeve 14 at opening 26*b*, while the other end of the strap 18 may attach to the sleeve 14 through openings 26*d* and 26*f*, as shown, thereby providing for hands-free support of the can 94 with the can 94 in an upright position.

In practice, it is generally advantageous to reach the second container supporting configuration by wrapping the sleeve 14 around the container 94 and attaching the first fastener portion 50 and the third fastener portion 58 such that the container fits snugly within the container-surrounding opening. When in the first container supporting configuration, the cavity closes at the bottom via zipper 82. However, there may be no bottom to the container-surrounding opening defined by the second container supporting configuration. As such, it is important to ensure that the container-surrounding opening is just wide enough to accommodate the container 94, but not wide enough to allow the container 94 fall through the bottom of the container-surrounding opening. It is contemplated that a portion of the outside surface O of the sleeve 14 may include gripping protrusions (not shown), such as those used with gripping gloves. The protrusions may be made from silicone or any other suitable material. The gripping protrusions may be placed strategically along the outside surface O so as to prevent the can 94 from slipping through the container-surrounding opening. The gripping protrusions may be placed in a purposeful design, such as a company logo or a time and place indicating phrase such as "LAS VEGAS 2014."

Figure 7:
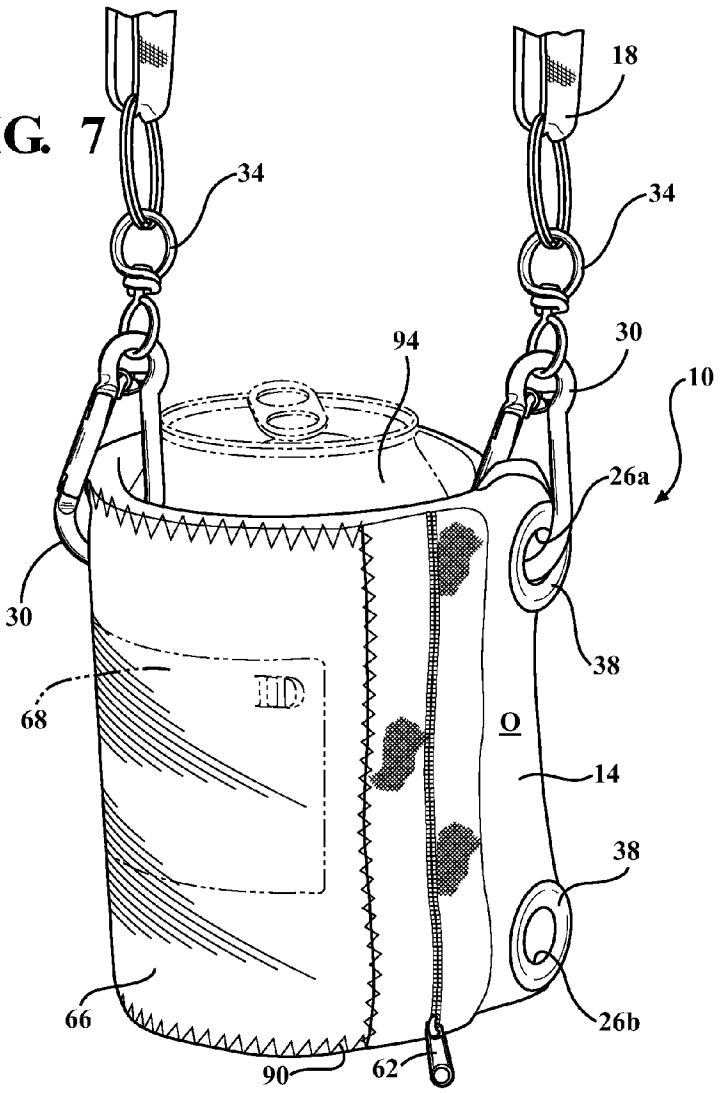
FIG. 7 illustrates a front view of the article holder in the second container supporting configuration.

Turning briefly to FIG. 7, a front view of the article holder 10 in the second container supporting configuration is shown. It can be seen that by attaching the strap 18 at opening 26*a* and openings 26*e-f*, the can 94 may be carried upright. When the article holder is worn such that the front view is visible, identification 68 can still be viewed through the panel 66 when the panel 66 is transparent. It is important to note that when the article holder 10 is in the first container supporting configuration, the inner surface I of the sleeve 14 contacts the container 76, while when the article holder 10 is in the second container supporting configuration, the outer surface O of the sleeve 14 contacts the container 94.

Figure 8:
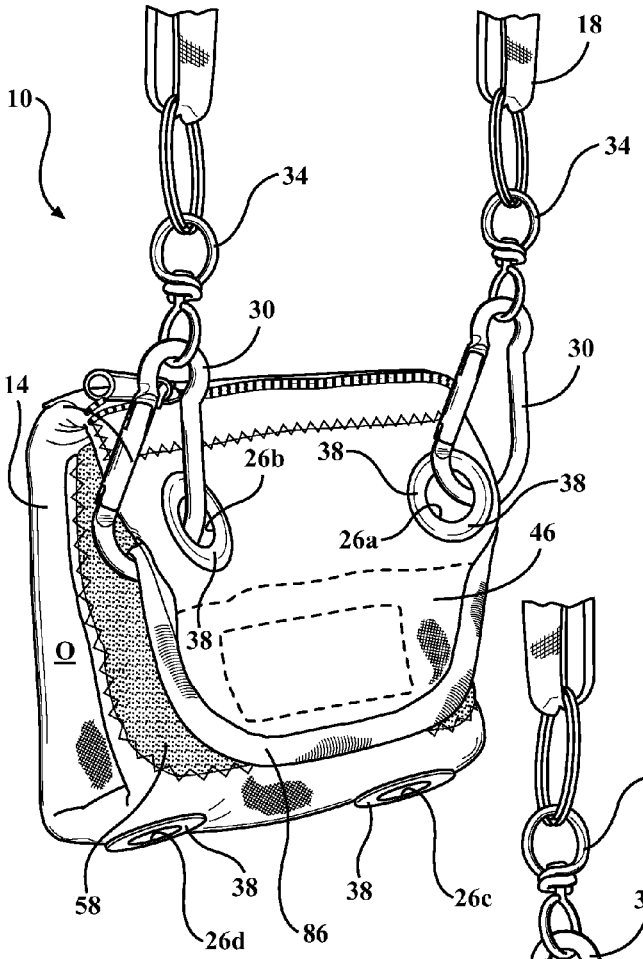
FIG. 8 illustrates a rear view of the article holder of FIG. 1 in a second storage configuration.
Figure 9:
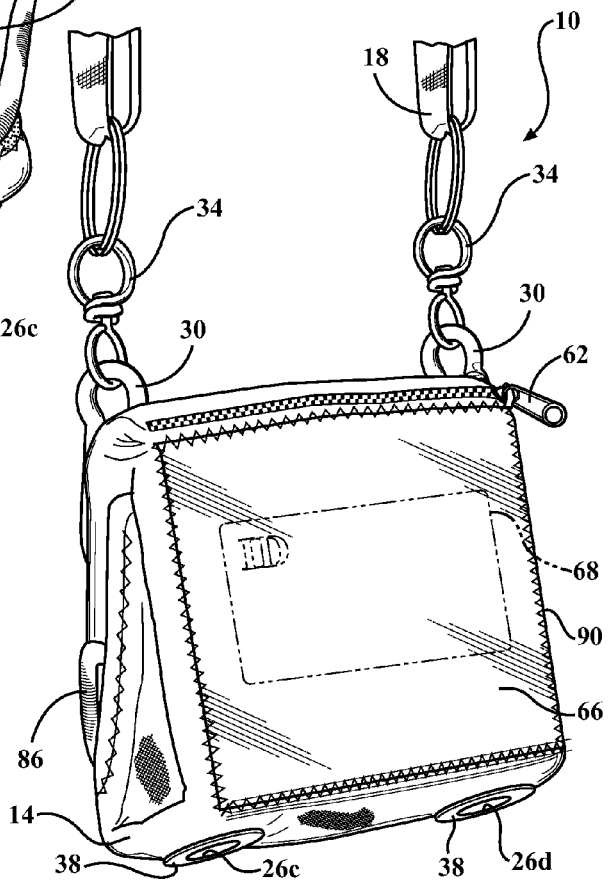
FIG. 9 illustrates a front view of the article holder in the second storage configuration.

Turning now to FIG. 8 and FIG. 9, the article holder 10 is shown in a second storage configuration. The second storage configuration is akin to a wallet-type configuration, and can be achieved by attaching the first fastener portion 50 and the third fastener portion 58 such that the first fastener portion 50 substantially covers the third fastener portion 58. The second storage configuration is similar to the second container supporting configuration in that the first fastener portion 50 releasably attaches to the third fastener portion 58. However, when the article holder 10 is in the second storage position, the container-surrounding opening is greatly restricted in size, thus preventing the support of an average-sized container.

Another difference between the second container supporting configuration and the second storage configuration may be in the placement of the strap 18. As shown in FIG. 8 and FIG. 9, the strap 18 may extend through the sleeve 14 at openings 26*a-b*. When worn by a user in this configuration, the size-restricted container-surrounding opening extends longitudinally with respect to the wearer. Thus, even if the container-surrounding opening could accommodate a container, the container would be held sideways in such a configuration.

While four configurations of the article holder 10 of the present invention have been described herein, it should be appreciated that the convertible nature of the article holder 10 means that many more configurations may be achieved by, for example, moving the strap 18 and/or changing the interconnection of the fastener portions 50, 54, 58. Additionally, the inclusion of additional fastener portions would allow for even greater flexibility in the use of the invention. Fastener portions may be operable to attach the article holder 10 to another object, thereby providing hands-free container support without the need to "wear" the article holder 10 using the strap 18. For example, providing a magnetic fastener portion could allow the article holder 10 to be secured to another magnetic object in close proximity to the user. It is also contemplated that the device may be linked to a user's belt, such as by threading the belt through an opening created by attaching the first fastener portion 50 to either the second fastener portion 54 or the third fastener portion 58.

While the various modes for carrying out the invention have been described in detail, it is to be understood that the terminology used is intended to be in the nature of words and description rather than of limitation. Those familiar with the art to which this invention relates will recognize that many modifications of the present invention are possible in light of the above teachings. It is therefore to be understood that within the scope of the appended claims, the invention may be practiced in a substantially equivalent way other than as specifically described herein.

What is claimed is:

1. A reconfigurable article holder comprising:

a sleeve having an inner surface and an outer surface;

a cavity defined by the sleeve, with the cavity operable to receive and support a beverage container in a first container supporting configuration, wherein the inner surface of the sleeve contacts the beverage container;

first and second fastener portions disposed on the sleeve and mateable to form a container-surrounding opening operable to receive and support a beverage container in a second container supporting configuration, wherein the outer surface of the sleeve contacts the beverage container; and a third fastening portion, the first fastening portion being mateable with the third fastening portion to form a storage configuration, and an attachment of the first and third fastening portions closing the cavity for secure storage and transport of items within the article holder.

2. The reconfigurable article holder of claim 1 further comprising a strap attached to the sleeve configured to support the weight of a beverage container.

3. The reconfigurable article holder of claim 2, wherein the strap is detachable.

4. The reconfigurable article holder of claim 2, wherein the strap extends through the sleeve at at least one reinforced opening.

5. The reconfigurable article holder of claim 2, wherein the strap is adjustable.

6. The reconfigurable article holder of claim 1, wherein the first fastening portion is disposed on the inner surface of the sleeve and the second fastening portion is disposed on the outer surface of the sleeve.

7. The reconfigurable article holder of claim 1, wherein the first and second fastening portions are further mateable to form a second storage configuration, with the first and second fastening portions attaching so as to decrease the circumference of the container-surrounding opening such that the container-surrounding opening cannot support an average-sized beverage container when the article holder is in the storage configuration.

8. The reconfigurable article holder of claim 1 further comprising a securable pocket attached to the sleeve.

9. The reconfigurable article holder of claim 8, wherein the securable pocket seats within the cavity.

10. The reconfigurable article holder of claim 8, wherein the securable pocket is transparent such that items within the securable pocket may be viewable without removing the items from the securable pocket.

11. The reconfigurable article holder of claim 1, wherein the sleeve comprises a thermally insulating material.

12. The reconfigurable article holder of claim 1 further comprising at least one gripping protrusion disposed on the outer surface of the sleeve and operable to retain a beverage container within the container-surrounding opening when the article holder is in the second container supporting configuration.

13. A reconfigurable article holder comprising:

a sleeve;

a first opening through the sleeve;

a second opening through the sleeve, with the second opening being spaced from and generally horizontally aligned with the first opening;

a third opening through the sleeve, with the third opening being spaced from and generally vertically aligned with the first opening;

a cavity defined by the sleeve and operable to receive and support a beverage container in a first container supporting configuration;

first and second fastener portions disposed on the sleeve and mateable to form a container-surrounding opening operable to receive and support a beverage container in a second container supporting configuration rotated approximately ninety degrees from the first container supporting configuration;

an adjustable strap detachably connectable to the sleeve at one or more of the openings, with the strap connecting to the sleeve at the first and second openings when the article holder is in the first container supporting configuration and at the first and third openings when the article holder is in the second container supporting configuration; and a third fastening portion disposed on the sleeve and mateable with the first fastening portion to form a storage configuration, the strap connecting to the sleeve at the first and second openings when the article holder is in the storage configuration.

14. The reconfigurable article holder of claim 13, wherein the sleeve defines an inner surface and an outer surface, with the inner surface of the sleeve contacting a beverage container when the article holder is in the first container supporting configuration and the outer surface of the sleeve contacting a beverage container when the article holder is in the second container supporting configuration.

15. The reconfigurable article holder of claim 14, wherein first fastening portion is disposed on the inner surface of the sleeve and the second fastening portion is disposed on the outer surface of the sleeve.

16. The reconfigurable article holder of claim 13, wherein the first and second fastening portions are further attachable to form a second storage configuration, with the strap connecting to the sleeve at the first and second openings when the article holder is in the storage configuration.

17. The reconfigurable article holder of claim 13 further comprising a securable pocket attached to the sleeve.

18. The reconfigurable article holder of claim 13, wherein the sleeve comprises a thermally insulating material.

* * * * *